US009462929B2

(12) United States Patent
Park et al.

(10) Patent No.: US 9,462,929 B2
(45) Date of Patent: Oct. 11, 2016

(54) DISH WASHER

(71) Applicant: SAMSUNG ELECTRONICS CO., LTD., Suwon-si, Gyeonggi-do (KR)

(72) Inventors: Sang Hyun Park, Seongnam-si (KR); Dong Ho Park, Suwon-si (KR); Jung Yoon Hahm, Yongin-si (KR); Jee Yong Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 145 days.

(21) Appl. No.: 14/446,845

(22) Filed: Jul. 30, 2014

(65) Prior Publication Data

US 2015/0059198 A1 Mar. 5, 2015

(30) Foreign Application Priority Data

Sep. 2, 2013 (KR) ..... 10-2013-0104678

(51) Int. Cl.
*F26B 21/06* (2006.01)
*A47L 15/48* (2006.01)

(52) U.S. Cl.
CPC ..... *A47L 15/481* (2013.01)

(58) Field of Classification Search
CPC ..... F26B 19/00; F26B 21/00; F26B 21/06; B08B 3/00; B08B 3/02; A47L 15/00; A47L 15/46
USPC ..... 34/104, 105; 134/25.2, 58 D
See application file for complete search history.

(56) References Cited

U.S. PATENT DOCUMENTS 1,972,368 A * 9/1934 Alex ..... A61L 9/00 239/55
2,557,432 A * 6/1951 Holstedt ..... A61L 9/00 312/31
2,765,046 A * 10/1956 Rondholz ..... F24F 3/12 422/4
3,772,901 A * 11/1973 Ferraro ..... D06F 39/10 134/100.1

(Continued)

FOREIGN PATENT DOCUMENTS

EP 2389853 11/2011
EP 2389854 11/2011

(Continued)

OTHER PUBLICATIONS

Extended European Search Report dated Dec. 5, 2014 from European Patent Application No. 14181132.3, 5 pages.

*Primary Examiner* — Stephen M Gravini
(74) *Attorney, Agent, or Firm* — Staas & Halsey LLP

(57) ABSTRACT

A dish washer with an improved flow channel of air passing through an adsorbent includes a tub to wash dishes, a drying device to supply air into the tub to dry the dishes, and an adsorbent case provided in the drying device. The adsorbent case includes an inner space in which an adsorbent to adsorb moisture contained in air in the tub is provided, and at least one mesh unit located in the inner space to form a flow channel of air passing through the adsorbent. The flow channel is formed in the adsorbent using the mesh unit to reduce flow resistance of air flowing through the adsorbent. Air rapidly passes through the flow channel, thereby reducing drying time.

28 Claims, 9 Drawing Sheets

(56) References Cited

U.S. PATENT DOCUMENTS 5,174,462 A * 12/1992 Hames ..... B65F 7/00 220/522
6,170,166 B1 * 1/2001 Johansen ..... A47L 15/48 34/595
6,346,143 B1 * 2/2002 McGowan ..... A61L 9/12 96/117.5
6,780,101 B2 * 8/2004 Buhler ..... D06F 58/203 34/390
7,103,992 B2 * 9/2006 Duden ..... A47L 15/4291 134/102.3
7,347,005 B2 * 3/2008 Cerruti ..... A47L 15/486 134/95.2
7,367,134 B2 * 5/2008 Osvatic ..... D06F 58/20 137/514
7,389,782 B2 * 6/2008 Jung ..... A47L 15/4257 134/200
7,676,954 B2 * 3/2010 Classen ..... A47L 15/0013 34/486
8,601,716 B2 * 12/2013 Jerg ..... A47L 15/481 34/329
8,978,227 B2 * 3/2015 Haltmayer ..... A47L 15/4272 29/428
9,052,143 B2 * 6/2015 Janowski ..... A47L 19/04
9,080,812 B2 * 7/2015 Dreossi ..... A47L 15/481
2006/0096618 A1 * 5/2006 Price ..... A47L 15/0015 134/25.2
2008/0127997 A1 * 6/2008 Jerg ..... A47L 15/4285 134/10
2009/0235957 A1 * 9/2009 Kim ..... A47L 15/0007 134/25.2
2012/0273015 A1 * 11/2012 Jerg ..... A47L 15/4291 134/58 D
2015/0059198 A1 * 3/2015 Park ..... A47L 15/481 34/80

FOREIGN PATENT DOCUMENTS

JP 2011-528964 12/2011
JP 2011-528971 12/2011
KR FR 2924591 A1 * 6/2009 ..... A47L 15/0007
KR 20150026191 A * 3/2015 ..... A47L 15/481
KR EP 2842475 A1 * 3/2015 ..... A47L 15/481

* cited by examiner

DISH WASHER

CROSS-REFERENCE TO RELATED APPLICATIONS

This application claims the benefit of Korean Patent Application No. 10-2013-0104678, filed on Sep. 2, 2013 in the Korean Intellectual Property Office, the disclosure of which is incorporated herein by reference.

BACKGROUND

1. Field

Embodiments disclosed herein relate to a dish washer with an improved flow channel of air passing through an adsorbent.

2. Description of the Related Art

Generally, a dish washer refers to an apparatus that sprays high-pressure wash water to dishes to wash the dishes. The dish washer generally washes the dishes through a preliminary washing operation, a main washing operation, a rinsing operation, and a drying operation. During the preliminary washing operation, wash water is sprayed to the dishes without using detergent to remove leftovers from the dishes. During the main washing operation, wash water is sprayed to the dishes and, at the same time, detergent is supplied to the dishes through a detergent supply device to wash the dishes. During the rinsing operation, wash water is sprayed to the dishes to rinse the detergent out of the dishes. During the drying operation, moisture is removed from the dishes.

Generally, dishes may be dried using two methods, by way of example. In the first method, hot water may be supplied to the dishes at the rinsing operation and a fan is driven such that the high-temperature dishes evaporate moisture during the drying operation. In the second method, humid air in a tub may be supplied into an adsorbent, which adsorbs moisture, and dried air is introduced into the tub to dry the dishes. At this time, an exothermic reaction occurs in the adsorbent adsorbing the moisture. As a result, the temperature of air is increased. Consequently, the dishes may be dried without using heating energy.

The drying method using hot water may include an additional water heating operation to spray hot water to the dishes. As a result, electric power consumption is increased. In addition, hot steam may leak and damage furniture around the dish washer.

In the drying method using the adsorbent, a high-capacity fan may be used when air passes through the dense adsorbent considering high flow resistance of the air. As a result, great noise is generated and electric power consumption is increased.

SUMMARY

It is an aspect of the disclosure to provide a dish washer having a hollow space formed such that air may rapidly pass through an adsorbent.

It is another aspect of the disclosure to provide a dish washer wherein a flow area of air passing through an adsorbent is maximized, thereby improving adsorption efficiency and thus improving drying performance.

Additional aspects of the disclosure will be set forth in part in the description which follows and, in part, will be apparent from the description, or may be learned by practice of the disclosure.

In accordance with an aspect of the disclosure, a dish washer performing a drying cycle using an adsorbent may include a tub to receive dishes, a drying device to dry the dishes using the adsorbent, the drying device communicating with the tub, a fan provided on an air movement course to circulate air through the tub and the drying device, and a mesh unit, configured to (suitable for, capable of, adapted to, arranged to, operable to, etc.) have a hollow concavo-convex structure, provided in the drying device to reduce flow resistance of air passing through the adsorbent.

The drying device may include an adsorbent case, in which the adsorbent is provided, and a heater to transfer hot air to the adsorbent case such that the adsorbent is regenerated and the adsorbent case and the heater may be isolated from each other by a partition.

The partition may include at least one connection port configured (suitable for, capable of, adapted to, arranged to, operable to, etc.) such that air, introduced from the tub, passes through the heater and is introduced into the adsorbent case.

The concavo-convex structure may be configured to (suitable for, capable of, adapted to, arranged to, operable to, etc.) have a structure in which at least one connection port protrudes inwardly of the adsorbent case from the partition functioning as a bottom such that air introduced through the at least one connection port rapidly moves in the adsorbent.

The adsorbent case may be provided at an upper part thereof with an outer top including the at least one outlet port and an inner top of a storage space to store the adsorbent, the outer top and the inner top being spaced apart from each other, and a gap, through which air passes, may be defined between the outer top and the inner top.

The inner top may be provided with at least one slit, through which air having passed through the adsorbent flows to the gap.

The at least one slit may be arranged alternately with protruding portions of the concavo-convex structure to increase a contact area between air introduced into the adsorbent case through the at least one connection port and the adsorbent.

The gap may have a height of about 2 mm to about 20 mm.

A total area of the at least one slit through which air passes may be about 20 $cm^2$ to about 80 $cm^2$.

In accordance with another aspect of the disclosure, a dish washer may include a tub to wash dishes and a drying device to dry the dishes, wherein the drying device may include an adsorbent to adsorb moisture, a heater disposed adjacent to the adsorbent to provide hot air to the adsorbent such that the adsorbent is regenerated, and a mesh unit to form a hollow space in the adsorbent to reduce flow resistance of air passing through the adsorbent, the mesh unit including a distribution mesh disposed to distribute air and a mesh pipe to form a hollow passage in the adsorbent.

The adsorbent may be provided in an adsorbent case including at least one outlet port connected to the tub and a connection port, into which air having passed through the heater is introduced, and mesh nets to fix the adsorbent may be provided in the at least one outlet port and the connection port.

The distribution mesh may be provided at a middle part of the adsorbent case such that air introduced through the connection port moves in opposite directions and the mesh pipe may be connected to the distribution mesh and extends to opposite sides.

One side of the mesh pipe may be adjacent to the connection port and the other side of the mesh pipe may be adjacent to the outlet port such that air rapidly passes through the adsorbent.

In accordance with a further aspect of the disclosure, a dish washer may include a tub to wash dishes, a drying device to dry the dishes, and an adsorbent case provided in the drying device. The adsorbent case may include an inner space in which an adsorbent to adsorb moisture contained in air in the tub is provided, and at least one mesh unit located in the inner space to form a hollow flow channel to reduce flow resistance of air passing through the adsorbent.

A mesh ratio in terms of percent which may be obtained by dividing a volume of the mesh unit by a volume of the inner space, may be about 5% to about 30%.

A total mesh area of the mesh unit, through which air passes, may be about 800 $cm^2$ to about 1500 $cm^2$.

The adsorbent may include a plurality of grains each having a size of about 7 mm to about 20 mm.

The grains may have a density of about 200 $kg/m^3$ to about 500 $kg/m^3$.

In accordance with a further aspect of the disclosure, a dish washer may include a tub and a drying device to suction air from the tub via an inlet port, to remove moisture from the air using an adsorbent, and to discharge the air from which moisture has been removed into the tub via an outlet port. The drying device may include an adsorbent case to store the adsorbent, a heater, and a hollow structure disposed inside the adsorbent case which directs air suctioned from the tub toward the outlet port.

The heater may be disposed inside a heater case, the adsorbent case may include a connection port connected to the heater case to receive air suctioned from the tub, and the hollow structure may include a distribution mesh and a plurality of pipes extending from a first side of the distribution mesh and a second side of the distribution mesh, the distribution mesh receiving air from the heater case via the connection port and distributing the air into the plurality of pipes. The plurality of pipes may include holes to discharge the air distributed from the distribution mesh, toward the outlet port. The outlet ports may be disposed on opposite sides of a top of the adsorbent case and air may be discharged from the holes of the plurality of pipes toward the outlet ports. The heater case may have a length in a longitudinal direction which is shorter than a length of the adsorbent case in the longitudinal direction.

The hollow structure may include a mesh pipe and a mesh net surrounding the mesh pipe, the heater may be disposed inside the mesh pipe, and the adsorbent may be disposed between the mesh pipe and the mesh net.

The heater may be disposed inside a heater case, the adsorbent case may include a plurality of connection ports connected to the heater case to receive air suctioned from the tub, and a plurality of hollow structures may be disposed in the adsorbent case which correspond to the connection ports, the plurality of hollow structures receiving air from the heater case via the corresponding connection ports and directing the air toward a top of the adsorbent case. The top of the adsorbent case may include an outer top, an inner top having a plurality of slits, and a gap defined by the distance between the inner top and the outer top, and the plurality of hollow structures may direct air through the plurality of slits into the gap, and the air may be discharged from the gap into the tub via the outlet port. The outlet port may be disposed at a side of the adsorbent case which is adjacent to the top of the adsorbent case.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
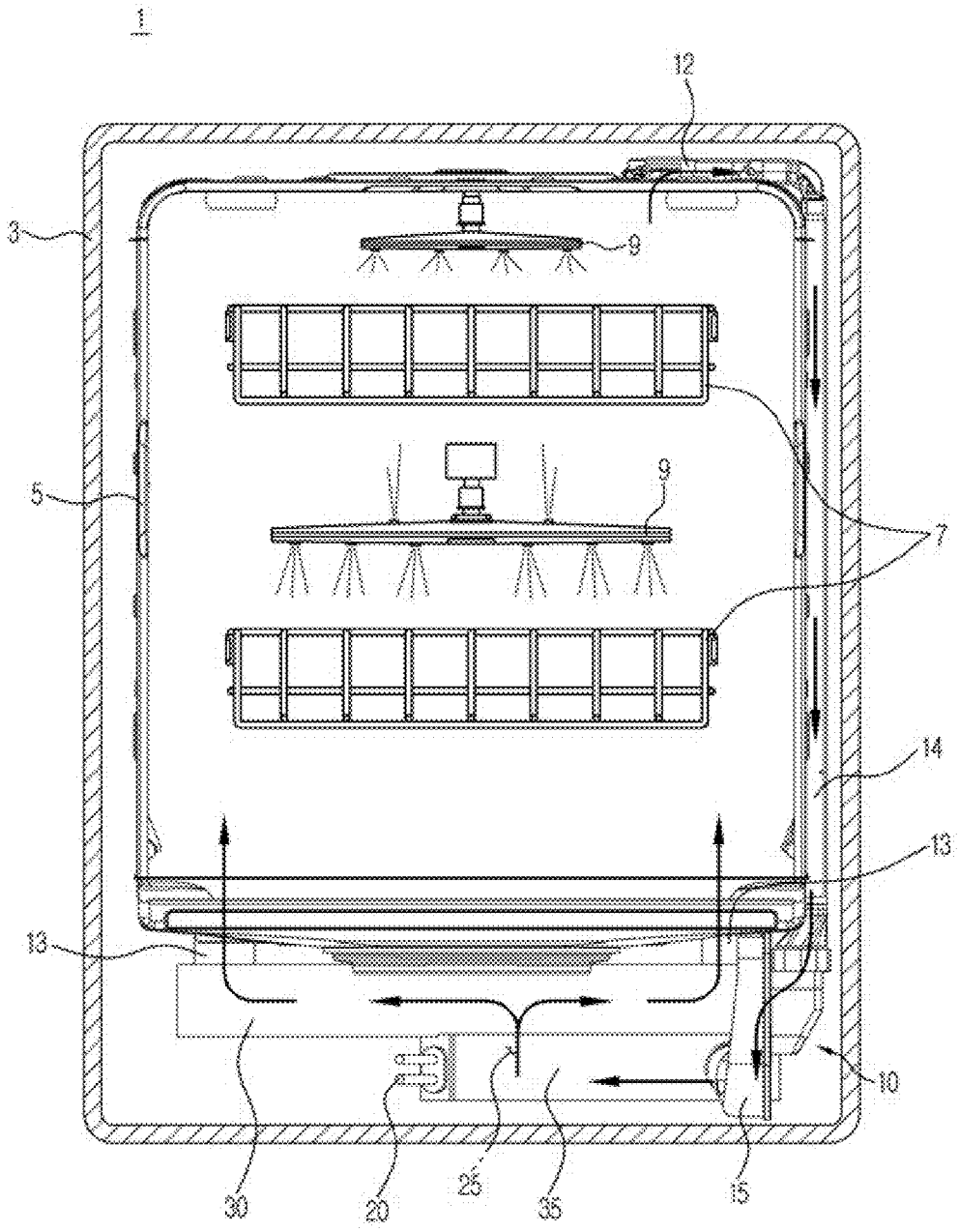
FIG. 1 is a view showing a dish washer according to an embodiment of the disclosure.

Reference will now be made in detail to example embodiments of the disclosure, the examples of which are illustrated in the accompanying drawings, wherein like reference numerals refer to like elements throughout.

Figure 2:
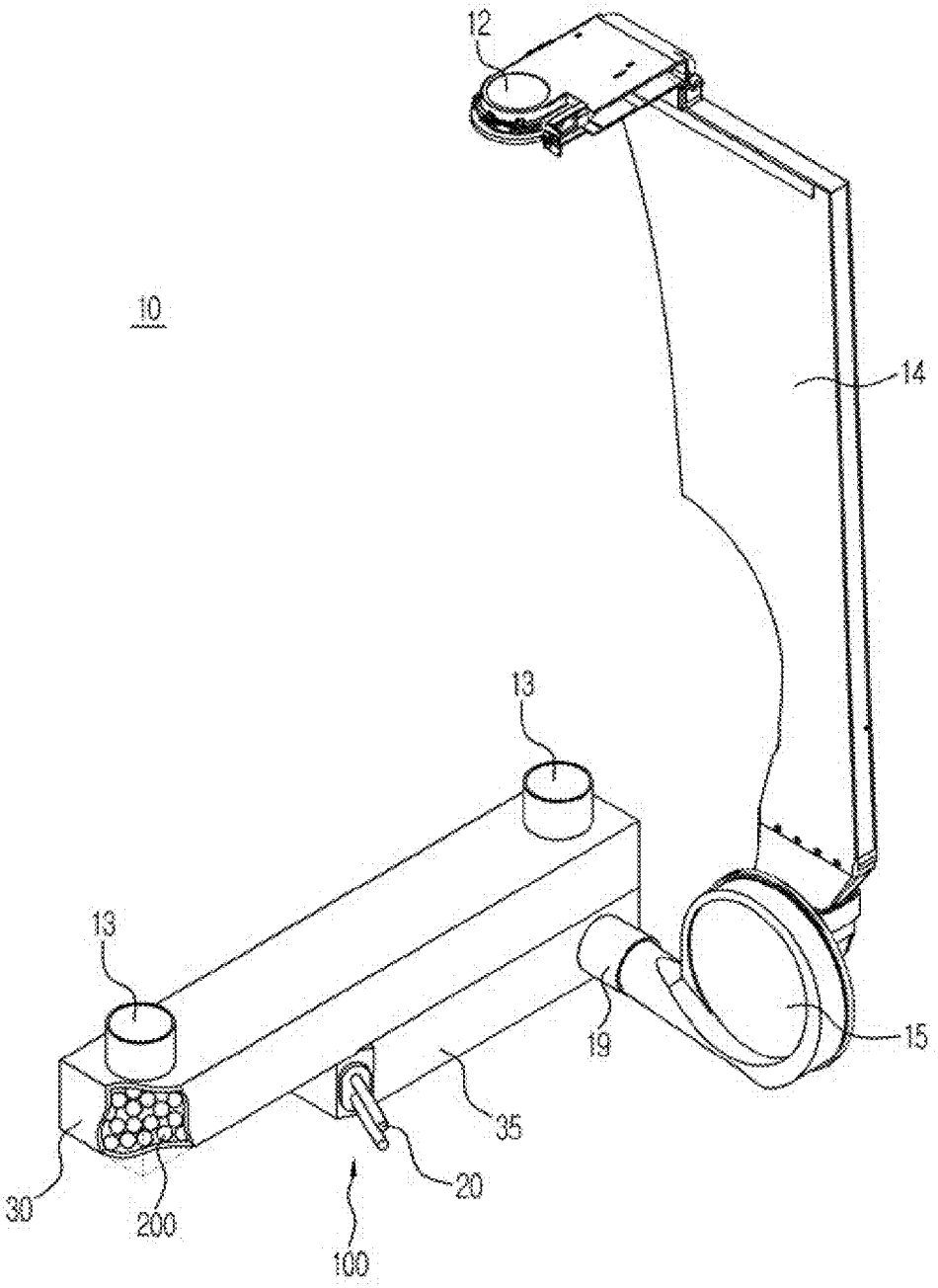
FIG. 2 is a view showing a drying device of the dish washer according to the embodiment of the disclosure.

FIG. 1 is a view showing a dish washer 1 according to an embodiment of the disclosure and FIG. 2 is a view showing a drying device 10 of the dish washer 1 according to the embodiment of the disclosure.

The dish washer 1 may include a cabinet 3 forming the external appearance of the dish washer 1, a tub 5 provided in the cabinet 3 to wash dishes, a water supply device (not shown) to supply water into the tub 5, and a drying device 10 to dry the dishes.

The front of the cabinet 3 may be opened such that dishes are received in the tub 5 or the dishes are removed from the tub 5. A door may be rotatably coupled to the cabinet 3 to open and close the tub 5.

One or more dish baskets 7 (sometimes referred to as racks) may be mounted in the tub 5. For example, a pair of dish baskets 7 as shown in FIG. 1, may be mounted in the upper part and the lower part of the tub 5 such that the dish baskets 7 are movable in an inward and outward direction. The upper side of each of the dish baskets 7 may be open to provide a receiving part to receive dishes. The dish baskets 7 may be slidably movable such that the dish baskets 7 may be inserted into or withdrawn from the cabinet 3 through the opened front of the cabinet 3. Each of the dish baskets 7 may be formed of wires arranged in the shape of a lattice such that dishes received in each of the dish baskets 7 may be washed while being exposed outward from each of the dish baskets 7.

At at least one side of the tub 5 may be mounted a spray unit 9 to spray wash water to the dish baskets 7. The spray unit 9 may be provided to spray wash water into the tub 5. The spray unit 9 may be fixed to at least one side of the tub 5 such that the spray unit 9 may spray water to the upper and lower ends of the dish baskets 7. That is, water may be sprayed in upward and downward directions. For example, the spray unit may include one or more spray units disposed in the dish washer. For example, as shown in FIG. 1, a first spray unit may be arranged or provided between the upper and lower dish baskets 7, and may spray water in an upward and/or downward direction. A second spray unit may be arranged or provided above the upper dish basket 7. The disclosure is not limited to the dish washer of FIG. 1, and additional spray units or injection nozzles may be provided in the dish washer (for example, at a location below the lower dish basket 7). Further, the spray units may be rotatable, and may rotate while spraying water.

The water supply device may include a washing pump to pump wash water at high pressure, a pump motor to drive the washing pump, and a drainage pump to drain wash water. The water supply device may further include a heater to heat wash water. The heater may be provided separately from a heater 20 of the drying device 10.

The drying device 10 may include a fan 15 to forcibly circulate air. The drying device 10 may suction air from the tub 5 to remove moisture from the air and return the air to the tub 5. The tub 5 and the drying device 10 may be connected to each other via an inlet port 12, through which air is suctioned from the tub 5, and an outlet port 13, through which air is resupplied into the tub 5.

The inlet port 12 may be located at the top of the tub 5 to introduce air from the tub 5 to the drying device 10. Air, introduced through the inlet port 12, may move downward via a suction duct 14 fixed to the side of the tub 5. Under the tub 5 may be located an adsorbent 200 to adsorb moisture contained in circulating air and a heater 20 to regenerate the adsorbent 200 by heating air. The drying device 10 and the adsorbent 200 and the heater 20 located under the drying device 10 may constitute a drying unit 100. Air, having passed through the adsorbent 200, may be reintroduced into the tub 5 through the outlet port 13 which may be connected to the bottom of the tub 5. To improve drying efficiency, a plurality of outlet ports 13 may be provided at the bottom of the tub 5.

The adsorbent 200 may be a solid material which adsorbs gas or solution molecules. The adsorbent 200 may include one or more or a combination thereof of activated carbon, zeolite, silica gel, alumina, and charcoal. The adsorbent 200 may be provided in a form of grains or in a monolithic form having a uniform shape. When the adsorbent 200 adsorbs gas, an exothermic reaction occurs in the adsorbent 200. When heat is applied to the adsorbent 200, on the other hand, gas is removed from the adsorbent 200.

The heater 20 may apply heat to the adsorbent 200 to remove gas from the adsorbent 200 and thus regenerate the adsorbent 200 such that the adsorbent 200 may readsorb moisture. The heater 20 and the adsorbent 200 may be sequentially disposed along a movement course of air such that the air, the temperature of which has been increased by the heater 20, regenerates the adsorbent 200 while passing through the adsorbent 200. A heater case 35, in which the heater 20 is provided, may be connected to a suction duct 14. For example, at one side of the heater case 35 may be provided a connection member 19, connected to the suction duct 14, through which air is introduced into the drying unit 100. The adsorbent 200 may be provided in an inner space of an adsorbent case 30. Air, having passed through the heater 20, may be introduced into the adsorbent case 30 via a connection port 25 connected to the adsorbent case 30.

Operation of the dish washer 1 may be divided, for example, into a washing operation to spray water to dishes to wash the dishes and a drying operation to remove moisture from the dishes. The fan 15 may be continuously driven during the washing operation and the drying operation such that air may circulates through the tub 5 and the drying device 10. During the washing operation, the heater 20 may be driven to heat air introduced from the tub 5 and the heated air may pass through the adsorbent 200. The heated air may separate moisture from the adsorbent 200 and absorb the moisture. The air containing the moisture may be introduced into the tub 5 to facilitate the washing operation. During the drying operation, the heater 20 may not be driven. Moisture may be separated from air while passing through the adsorbent 200 and the adsorbent 200 may adsorb the moisture. At this time, an exothermic reaction occurs in the adsorbent 200. As a result, the temperature of the air is increased. The dried air having a higher temperature relative to the temperature of the air before the moisture was separated, may be introduced into the tub 5 to effectively dry the dishes.

The adsorbent 200 may be provided in the adsorbent case 30 such that the adsorbent 200 adsorbs moisture while air is introduced through the connection port 25 located at the lower side of the adsorbent case 30 and is discharged through the outlet port 13 located at the upper side of the adsorbent case 30. The adsorbent 200 may be provided in the adsorbent case 30 at a high density such that air passing through the adsorbent 200 suffers from high resistance. To reduce such high resistance, the adsorbent 200 may include at least one mesh unit to form a hollow space.

The adsorbent 200 may be provided in a form of grains. Each grain may have, for example, a size of about 7 mm to about 20 mm such that the distance between the grains is large to reduce resistance generated while air passes through the adsorbent 200. The grains may be put in any container to measure density of the grains. The grains may have, for example, a density of 200 $kg/m^3$ to 500 $kg/m^3$.

Figure 3:
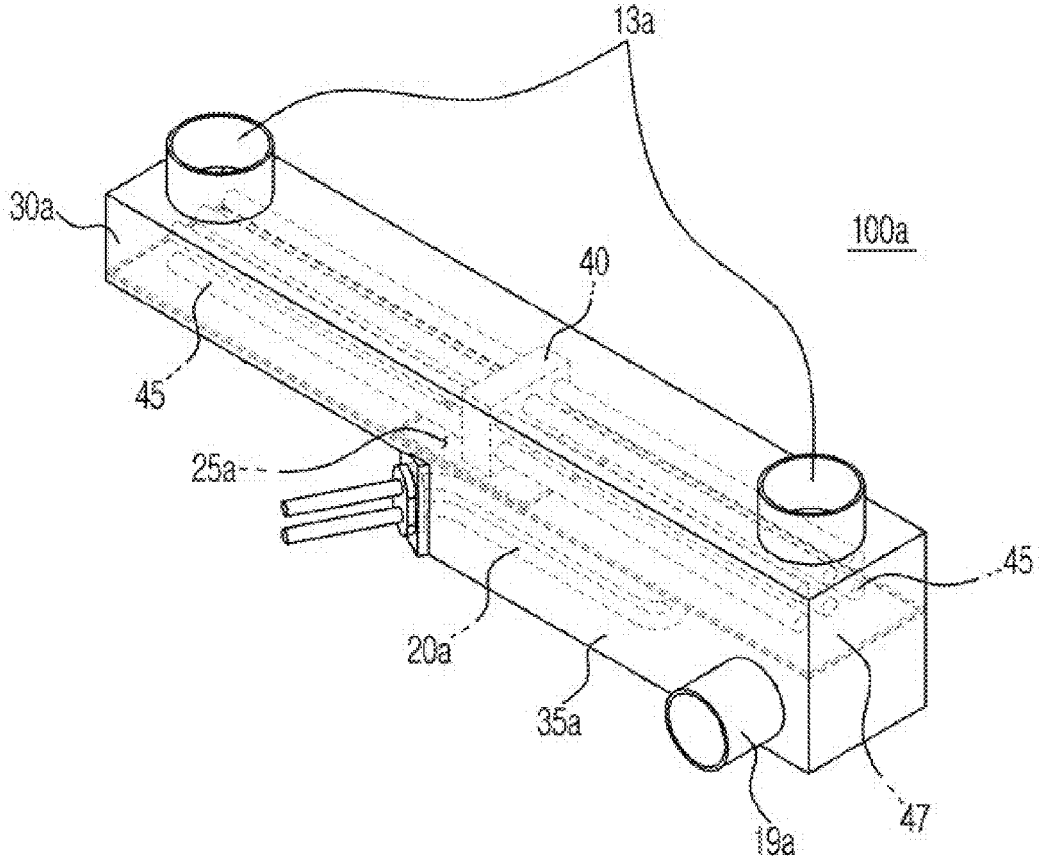
FIGS. 3 and 4 are views showing a drying unit of the dish washer according to an embodiment of the disclosure.
Figure 4:
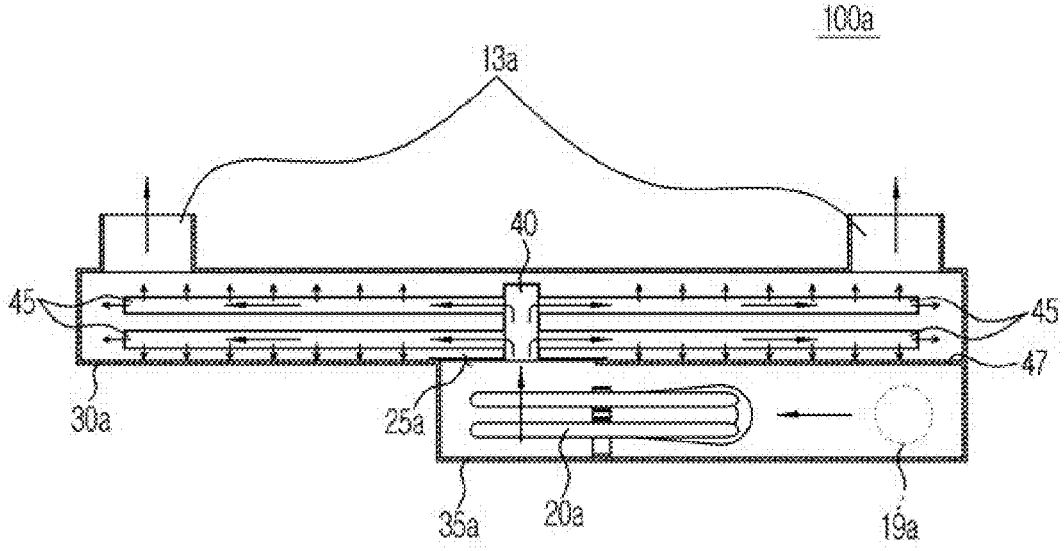

FIGS. 3 and 4 are views showing a drying unit 100*a* of the dish washer 1 according to an embodiment of the disclosure.

The drying unit 100*a* may include an adsorbent case 30*a*, in which an adsorbent to adsorb moisture is provided, and a heater case 35*a*, in which a heater 20*a* to regenerate the adsorbent is provided. At one side of the heater case 35*a* may be provided a connection member 19*a*, connected to the suction duct, through which air is introduced into the drying unit 100*a*. The adsorbent case 30*a* may include at least one outlet port 13*a* connected to the tub 5 and a connection port 25*a*, through which air having passed through the heater 20*a* is introduced.

In an inner space of the adsorbent case 30*a*, in which the adsorbent is provided, may be provided a mesh pipe 45 and a distribution mesh 40 defining a hollow space. The distribution mesh 40 may be disposed such that air introduced through the connection port 25*a* is divided, for example, into two air components moving in opposite directions and the two air components pass through the adsorbent. One side of the mesh pipe 45 may be adjacent to the connection port 25*a* and the other side of the mesh pipe 45 may be adjacent to the outlet port 13*a* such that air rapidly passes through the adsorbent.

The adsorbent case 30*a* may be wider than the heater case 35*a* such that the adsorbent case 30*a* contains an adsorbent sufficient to adsorb moisture of air in the tub 5. The adsorbent case 30*a* and the heater case 35*a* may extend in the longitudinal direction considering a space for other components, such as the water supply device, located under the tub 5. The heater case 35*a*, including an inner space to receive the heater 20*a*, may be provided under the adsorbent case 30*a*. The longitudinal direction may refer to a horizontal direction which is perpendicular to a lateral or front to back direction of the dish washer, and perpendicular to vertical direction (e.g., top to bottom direction of the dish washer).

The heater case 35*a* and the adsorbent case 30*a* may be isolated from each other by a partition 47 such that air introduced through the connection member 19*a* passes through the heater 20*a* and enters the adsorbent case 30*a*. The connection port 25*a*, through which air having passed through the heater 20*a* is introduced into the adsorbent case 30*a*, may be provided at the partition 47. That is, the connection member 19*a* may be provided at one side (a first end) of the heater case 35*a* and the connection port 25*a* may be provided at the other side (a second end) of the heater case 35*a* such that entirety of air passes through the heater 20*a*.

The heater case 35*a* may be shorter than the adsorbent case 30*a*. Consequently, the connection port 25*a* may be located at the middle (e.g., the center) of the bottom of the adsorbent case 30*a*. The distribution mesh 40 may be provided at the middle (e.g., the center) of the connection port 25*a* such that air introduced through the connection port 25*a* moves in opposite directions of the adsorbent case 30*a*. The distribution mesh 40 may include a net, through which air passes. The distribution mesh 40 may be formed in a cubic shape. The distribution mesh 40 may be formed in a quadrangular shape identical to the shape of a section of the adsorbent case 30*a* such that air is divided in opposite directions.

The mesh pipe 45 may extend to opposite sides while being connected to the distribution mesh 40. A plurality of mesh pipes 45 may be provided such that air contact adsorbent while moving along several courses. The mesh pipe 45 may be a net, through which air passes, formed in the shape of a pipe. The mesh pipe 45 may extend along the inner shape of the adsorbent case 30*a* extending in the longitudinal direction.

The outlet ports 13*a* may be located at opposite sides of the top of the adsorbent case 30*a*. Air may be introduced into the tub 5 through the outlet ports 13*a* such that the air having passed through the drying unit 100*a* is uniformly distributed in the tub 5. The uniformly distributed air may efficiently absorb moisture of dishes to reduce drying time. Mesh nets to fix the adsorbent may be mounted in at least one of the outlet ports 13*a* and the connection port 25*a*.

The adsorbent fills the adsorbent case 30*a* in the form of grains. When air passes through the adsorbent, therefore, the air may suffer from high flow resistance. To reduce the flow resistance, each grain may have a size of about 7 mm to about 20 mm.

As shown in FIG. 4, air, introduced into the heater case 35*a* through the connection member 19*a*, passes through the heater 20*a* and enters the connection port 25*a*. At this time, the heater 20*a* is driven to transfer heat to air during the washing operation and the heater 20*a* is not driven and merely serves as a path, along which air moves, during the drying operation. A large portion of the air, introduced into the adsorbent case 30*a* through the connection port 25*a*, may move to the hollow distribution mesh 40, in which the air suffers from low flow resistance, and may move along the mesh pipe 45 connected to the distribution mesh 40 in opposite directions. The air may be discharged from the mesh unit through mesh portions (holes) of the distribution mesh 40 and the mesh pipe 45. At this time, the air contacts the adsorbent with the result that moisture is removed from the air. Subsequently, the air may move to the tub 5 through the outlet port 13*a*. For example, as shown in FIG. 4, air moves in an upward direction through connection port 25*a* into the hollow distribution mesh 40. A portion of the air may move toward a first direction into one or more of a plurality of mesh pipes 45 (for example a left direction), and a portion of the air may move in a second direction, opposite of the first direction, into one or more of a plurality of mesh pipes 45 (for example a right direction). A plurality of holes may be formed in one or more of mesh pipes 45 such that air in the mesh pipes is discharged through the holes and contacts the adsorbent. For example, a plurality of holes may be regularly and/or irregularly distributed on upper and/or lower portions of the mesh pipes. For example, holes may be disposed at an end portion of a mesh pipe, such that air is discharged in a longitudinal direction. Holes may be distributed such that air is discharged away in a direction that does not conflict with a discharge direction of other mesh pipes. Holes may be distributed circumferentially about the mesh pipes so that air is discharged about the pipe in multiple directions. Further, a mesh pipe may be formed in shapes other than that shown in FIG. 3. For example, a mesh pipe may be formed to be substantially S-shaped or serpentine shaped, coil shaped, spiral shaped, square-wave shaped, or be formed such that the pipe extends in two or more of the longitudinal, lateral, and vertical directions.

A value obtained by dividing a volume of the mesh unit by a volume of the inner space of the adsorbent case 30*a* may be defined as a mesh ratio in terms of a percentage value. For example, the mesh ratio may be about 5% to about 30%. If the mesh ratio is high, the volume of the adsorbent is relatively small with the result that the adsorbent may not sufficiently adsorb moisture. On the other hand, if the mesh ratio is low, flow resistance of air passing through the adsorbent may increase.

The total mesh area of the mesh unit, through which air passes, may be, for example, about 800 $cm^2$ to about 1500 $cm^2$. For example, the mesh unit may include mesh nets provided in the distribution mesh 40, the mesh pipe 45, and the connection port 25*a*. A mesh net may be provided in the outlet port 13*a* and may serve to prevent the adsorbent from being discharged outward by air. Consequently, the mesh net provided in the outlet port 13*a* is not included in the mesh unit. That is, only an area through which air passes such that the air contacts the adsorbent to exchange moisture with the adsorbent is defined as a mesh area.

Figure 5:
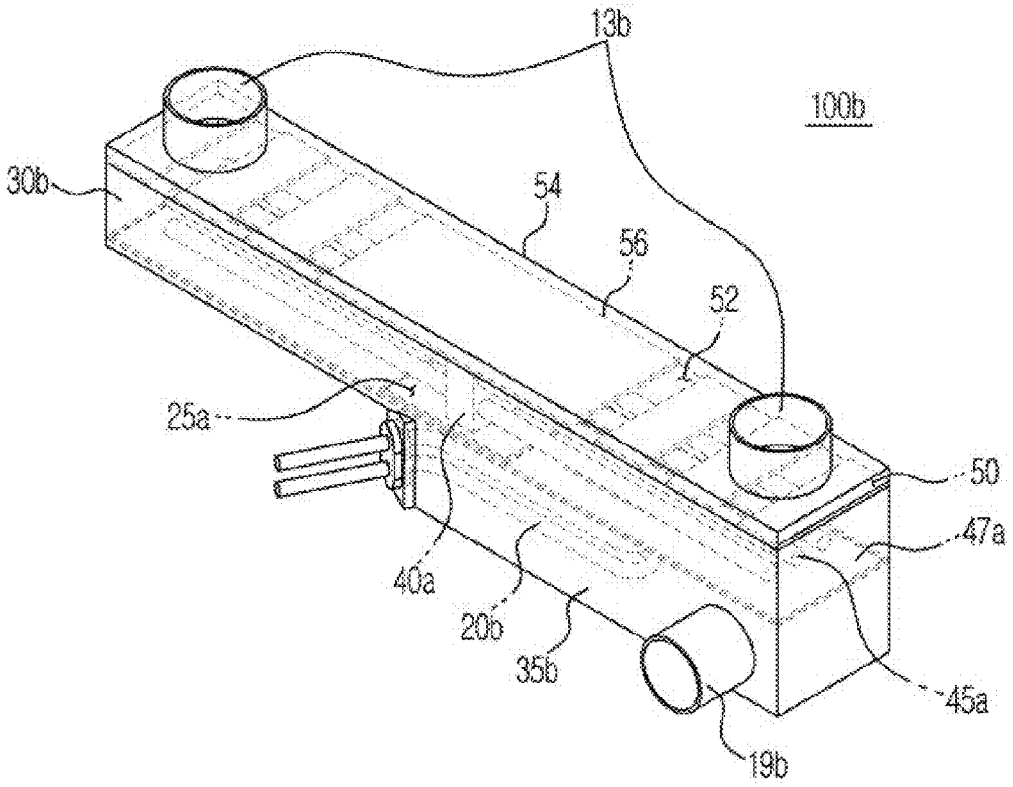
FIGS. 5 and 6 are views showing a drying unit of the dish washer according to an embodiment of the disclosure.
Figure 6:
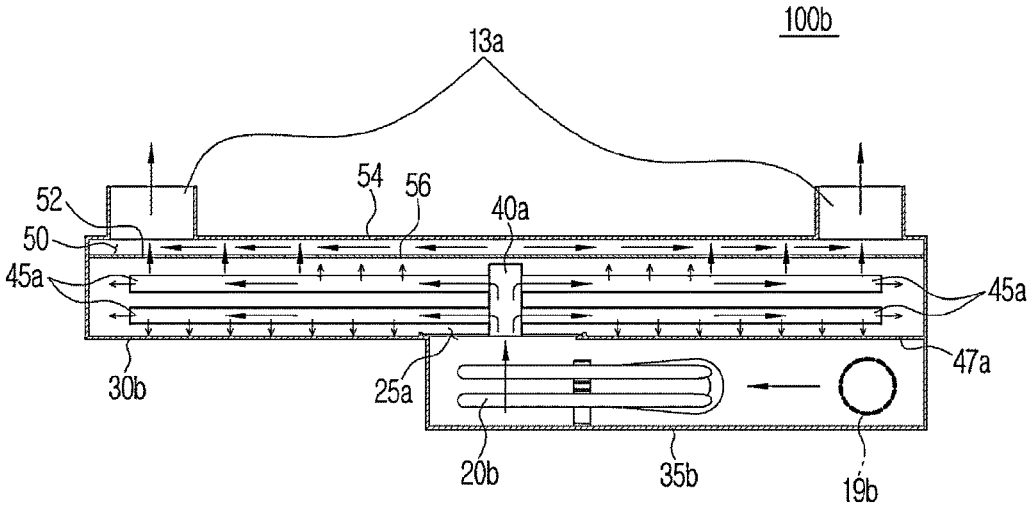

FIGS. 5 and 6 are views showing a drying unit 100*b* of the dish washer 1 according to an embodiment of the disclosure.

The drying unit 100*b* may further include a gap 50 defined in the upper part of an adsorbent case 30*b* such that air passes through the gap 50 in addition to the components disclosed above with respect to FIGS. 3 and 4. In the disclosure with respect to FIGS. 3 and 4, air having passed through the adsorbent may be directly discharged outward through outlet ports 13*b* provided at opposite sides of the top of the adsorbent case 30*b*. However, as disclosed below with respect to FIGS. 5 and 6, air may pass through slit 52 and may be discharged outward through the outlet ports 13*b* via the gap 50. Also, the drying unit 100*b* may include heater 20*b*, heater case 35*b*, the connection member 19*b* and partition 47*a*.

In the upper part of the adsorbent case 30*b* may be provided an outer top 54 including at least one outlet port 13*b* and an inner top 56 of a storage space to store the adsorbent in a state in which the outer top 54 and the inner top 56 are spaced apart from each other. The gap 50 may be defined, for example, as a distance between the outer top 54 and the inner top 56. The inner top 56 may be provided with at least one slit 52, through which air having passed through the adsorbent flows to the gap 50. In the slit 52 may be provided a mesh net to fix the adsorbent.

Unlike the disclosure above with respect to FIGS. 3 and 4 in which air introduced through the connection port 25*a* provided at the middle of the adsorbent case moves to opposite sides of the adsorbent case, the air may leave the adsorbent through the slit 52 provided at the top before the air moves to the opposite sides of the adsorbent case. Consequently, a large amount of air may pass through the adsorbent along a shorter flow channel.

The gap 50 may have a height of about 2 mm to about 20 mm. That is, the outer top 54 and the inner top 56 may be spaced apart from each other by about 2 mm to about 20 mm. If the gap 50 is large, volume of the drying unit 100*b* in the dish washer 1 may increase. On the other hand, if the gap 50 is small, flow resistance of air passing through the adsorbent may increase.

The total area of the at least one slit 52 provided at the inner top 56 may be about 20 $cm^2$ to about 80 $cm^2$. A plurality of slits 52 may be provided such that air may be discharged along several courses. The total area refers to the sum of areas of the slits 52 through which air passes. The plurality of slits 52 may have an area which is equal to one another, or the slits may have areas which are different from one another. If a plurality of slits are distributed along the inner top 56, the plurality of slits may increase in area from a center of the inner top 56 toward the ends of the inner top 56, or vice versa. For example, an area of a slit disposed near the center of the inner top 56 in a longitudinal direction may be relatively smaller (e.g., minimal) than an area of a slit disposed at an end of the inner top 56 in a longitudinal direction which may be relatively larger (e.g., maximal). The plurality of slits may be disposed or arranged symmetrically on either side of a center of the inner top 56, or may be disposed or arranged asymmetrically.

A mesh ratio may be about 5% to about 30%. The total mesh area of the mesh unit, through which air passes, may be about 800 $cm^2$ to about 1500 $cm^2$. The total mesh area may include mesh nets provided in a distribution mesh 40*a*, a mesh pipe 45*a*, and a connection port 25*a*. The mesh net provided in the slit 52 may not be included in the total mesh area.

Figure 7:
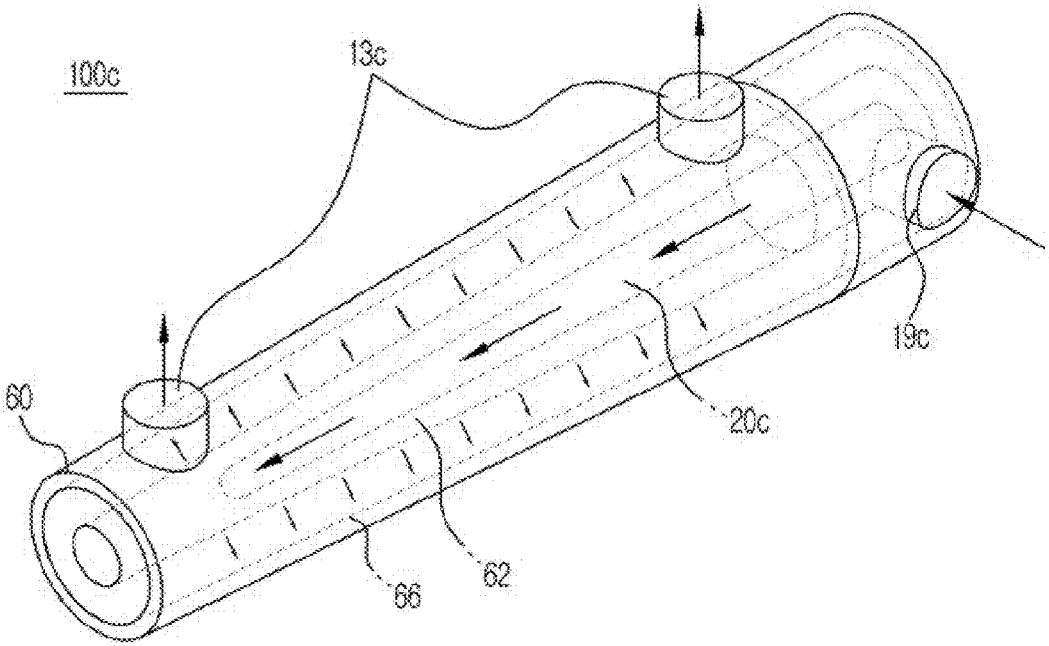
FIG. 7 is a view showing a drying unit of the dish washer according to an embodiment of the disclosure.

FIG. 7 is a view showing a drying unit 100*c* of the dish washer 1 according to an embodiment of the disclosure.

The drying unit 100*c* may include an outer flow channel 60 including outlet ports 13*c* and an inner flow channel 62 including an inlet port. The inner flow channel 62 may be mounted in the outer flow channel 60. The inlet port of the drying unit 100*c* may be a connection member 19*c* connected to a suction duct. The outer flow channel 60 and the inner flow channel 62 may be formed in a substantially cylindrical shape having a concentric circle.

Between the outer flow channel 60 and the inner flow channel 62 may be disposed an adsorbent to adsorb moisture in air. The inner flow channel 62 may be configured or arranged as a mesh pipe such that air, introduced into the inner flow channel 62 through the connection member 19*c*, passes through the adsorbent and flows to the outer flow channel 60. A mesh net 66 may be provided such that the adsorbent is spaced apart from the inside of the outer flow channel 60. That is, the adsorbent may be fixed between the inner flow channel 62 configured as the mesh pipe and the mesh net 66.

In the inner flow channel 62 may be provided a heater 20*c* to transfer heat to air such that the adsorbent may be regenerated. The connection member 19*c* may be connected to one side of the inner flow channel 62 through the outer flow channel 60. The outer flow channel 60 may be provided at one side thereof with a plurality of outlet ports 13*c* to improve drying efficiency. The sides of the inner flow channel 62 and the outer flow channel 60 at which the connection member 19*c* is located may have a greater section than the other sides of the inner flow channel 62 and the outer flow channel 60. That is, the inner flow channel 62 may be substantially shaped as a conical frustum, such that an end of the inner flow channel 62 closest to the connection member 19*c* may have a greater diameter than a diameter of an opposite end of the inner flow channel 62. Similarly, the outer flow channel 60 may be substantially shaped as a conical frustum, such that an end of the outer flow channel 60 closest to the connection member 19*c* may have a greater diameter than a diameter of an opposite end of the outer flow channel 60.

Air in the tub may move along the suction duct and may be introduced into the inner flow channel 62 of the drying unit 100*c* via the connection member 19*c*. Due to pressure, the air may be forced to move to the other side of the inner flow channel 62 opposite to the side of the inner flow channel 62 at which the connection member 19*c* is located. At this time, the air may flow in a circumferential direction through a mesh of the inner flow channel 62 configured or arranged as the mesh pipe. The air having passed through the adsorbent may move along the outer flow channel 60 and may be discharged through the outlet ports 13*c* located at opposite sides of the outer flow channel 60.

The adsorbent disposed between the inner flow channel 62 and the mesh net 66 may include a plurality of grains each having a size of about 7 mm to about 20 mm. The grains may have a density of about 200 $kg/m^3$ to about 500 $kg/m^3$.

Figure 8:
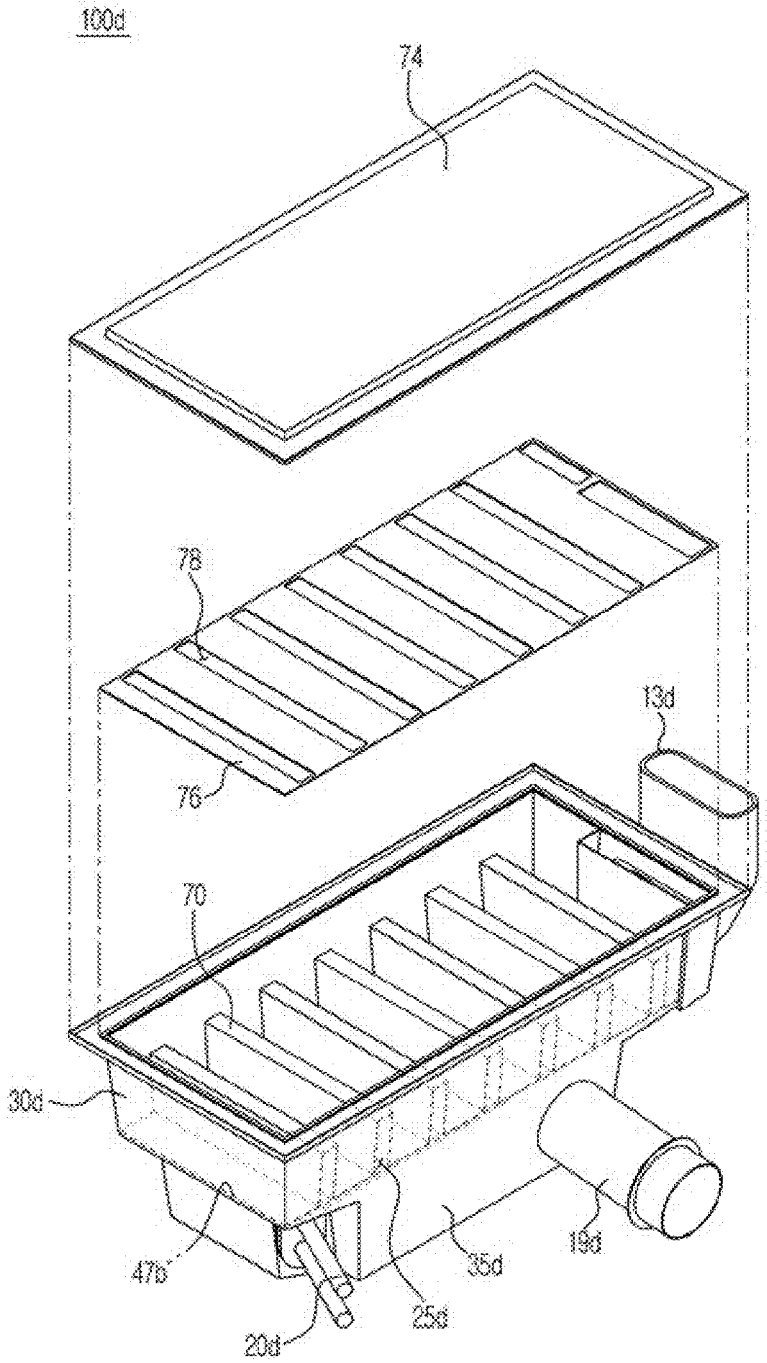
FIGS. 8 and 9 are views showing a drying unit of the dish washer according to an embodiment of the disclosure.
Figure 9:
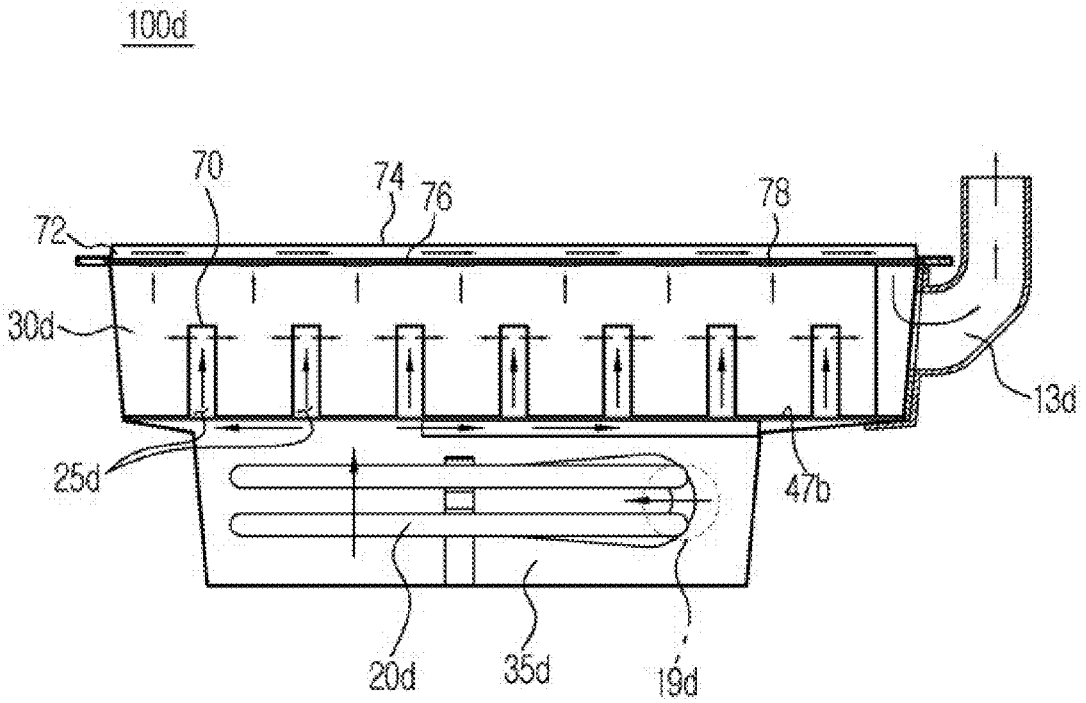

FIGS. 8 and 9 are views showing a drying unit 100*d* of the dish washer 1 according to an embodiment of the disclosure.

The drying unit 100*d* may include a heater case 35*d*, in which a heater 20*d* may be provided, and an adsorbent case 30*d*, in which an adsorbent may be provided. The heater case 35*d* and the adsorbent case 30*d* may be isolated from each other by a partition 47*b*. At one side of the heater case 35*d* may be provided a connection member 19*d*, connected to the suction duct, through which air is introduced into the drying unit 100*d*. The drying unit 100*d* may include a mesh unit configured or arranged to have a concavo-convex structure 70 to reduce flow resistance of air passing through the adsorbent. The partition 47*b* may include at least one connection port 25*d* configured or arranged such that air, introduced from the tub, passes through the heater 20*d* and is introduced into the adsorbent case 30*d*. Also, the drying unit 100*d* may include the connection member 19*d*.

The concavo-convex structure 70 may be configured or arranged such that at least one connection port 25*d* protrudes inwardly of the adsorbent case 30*d* from the partition 47*b* functioning as the bottom. The concavo-convex structure 70 may extend to the middle of the adsorbent case 30*d* such that air introduced through the connection port 25*d* may rapidly move along the concavo-convex structure 70.

In the upper part of the adsorbent case 30*d* may be provided an outer top 74 and an inner top 76 in a state in which the outer top 74 and the inner top 76 are spaced apart from each other. A gap 72 may be defined between the outer top 74 and the inner top 76, and may correspond to a distance between the outer top 74 and the inner top 76. The inner top 76 may be provided with at least one slit 78, through which air having passed through the adsorbent flows to the gap 72. In the slit 78 may be provided a mesh net to fix the adsorbent. A plurality of slits 78 may be provided such that air may be discharged along several courses. The plurality of slits 78 may have an area which is equal to one another, or the slits may have areas which are different from one another. If a plurality of slits are distributed along the inner top 76, the plurality of slits may increase in area from a center of the inner top 76 toward the ends of the inner top 76, or vice versa. For example, an area of a slit disposed near the center of the inner top 76 in a longitudinal direction may be relatively smaller (e.g., minimal) than an area of a slit disposed at an end of the inner top 76 in a longitudinal direction which may be relatively larger (e.g., maximal). The plurality of slits may be disposed or arranged symmetrically on either side of a center of the inner top 76, or may be disposed or arranged asymmetrically.

To increase a contact area between air introduced into the adsorbent case 30*d* and the adsorbent, the slits 76 may be arranged alternately with protruding portions of the concavo-convex structure 70. That is, an entrance through which air is introduced into the adsorbent case 30*d* and an exit through which the air is discharged from the adsorbent case 30*d* may not be arranged on the same line. Consequently, air introduced through the connection port 25*d* may be discharged through the slit 78 after the air contacts the adsorbent over a predetermined contact area.

The gap 72 may have a height of about 2 mm to about 20 mm. The total area of the at least one slit 78 provided at the inner top 76 may be about 20 $cm^2$ to about 80 $cm^2$. A mesh ratio may be about 5% to about 30%. The total mesh area of the mesh unit, through which air passes, may be about 800 $cm^2$ to about 1500 $cm^2$. The total mesh area may include a mesh net provided in the concavo-convex structure 70. The mesh net provided in the slit 78 may not be included in the total mesh area.

Air having passed through the adsorbent may be discharged outward through outlet ports, for example, outlet ports provided at opposite sides of the top of an outer top as shown in FIGS. 4 and 5. As shown in FIGS. 8 and 9, air having passed through the adsorbent may be discharged outward through an outlet port 13*d* which is disposed at a side of the adsorbent case 30*d*. For example, air may pass through one or more of the slits 78 into gap 72 and travel in a longitudinal direction toward a side at which the outlet port 13*d* is disposed. For example, as shown in FIGS. 8 and 9, air may be drawn from the gap 72 downward into a first portion of the outlet port 13*d* which may be disposed inside the adsorbent case 30*d*, and the air may be discharged outward into the tub at another portion of the outlet port 13*d* which is disposed on an outer side of the adsorbent case 30*d*. Alternatively, outlet ports 13*d* may be disposed at both side portions of the adsorbent case 30*d*, and air may pass through one or more of the slits 78 into gap 72 and travel in opposite longitudinal directions toward each side at which the outlet ports 13*d* are disposed.

A dish washing method may include performing a preliminary washing operation by spraying water into the tub and performing a main washing operation by spraying water into the tub and supplying detergent. During the preliminary washing operation and/or main washing operation, a heater may be driven to heat air introduced from the tub into a drying device and to remove moisture from an adsorbent so that the heated air absorbs moisture from the adsorbent. After the washing operation(s), the method may further include performing a rinsing operation to remove the detergent, and performing a drying operation to remove moisture. During the drying operation, the heater may not be driven. The performing of the drying operation may include suctioning air containing moisture from the tub into the drying device, removing the moisture from the air by adsorbing the moisture using the adsorbent, causing the adsorbent to have an exothermic reaction which heats the air, and discharging the air which has been heated due to the exothermic reaction and from which moisture has been removed, into the tub. Here, the above-described dish washing method may be implemented according to one or more (or combinations thereof) of the disclosed embodiments with respect to FIGS. 1-9. For example, any one or more (or combinations thereof), of the drying units, drying devices, etc. may be used to perform the above-described dish washing method.

As is apparent from the above description, the hollow space or structure may be formed in the adsorbent using the mesh unit to reduce flow resistance of air flowing through the adsorbent. In addition, air rapidly passes through the hollow space, thereby reducing drying time. By reducing flow resistance of air flowing through the adsorbent, a noise generated may be reduced.

Furthermore, the flow area of air passing through the adsorbent is maximized, thereby improving adsorption efficiency and thus improving drying performance.

Although example embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A dish washer to perform a drying cycle using an adsorbent, the dish washer comprising:

a tub;

a drying device to perform a drying cycle using the adsorbent, the drying device communicating with the tub; and a mesh unit, having a hollow concavo-convex structure, and provided in the drying device to reduce flow resistance of air passing through the adsorbent.

2. The dish washer according to claim 1, wherein the drying device comprises an adsorbent case, in which the adsorbent is provided, and a heater to transfer hot air to the adsorbent case such that the adsorbent is regenerated, and the adsorbent case and the heater are isolated from each other by a partition.

3. The dish washer according to claim 2, wherein the partition comprises at least one connection port, and air, introduced from the tub, passes through the heater and is introduced, via the at least one connection port, into the adsorbent case.

4. The dish washer according to claim 3, wherein the concavo-convex structure includes a structure in which at least one connection port protrudes inwardly of the adsorbent case from the partition.

5. The dish washer according to claim 4, wherein the adsorbent case is provided at an upper part thereof with an outer top comprising the at least one outlet port and an inner top of a storage space to store the adsorbent, the outer top and the inner top being spaced apart from each other, and a gap, through which air passes, is defined between the outer top and the inner top.

6. The dish washer according to claim 5, wherein the inner top is provided with at least one slit, through which air having passed through the adsorbent flows to the gap.

7. The dish washer according to claim 6, wherein the at least one slit is arranged alternately with protruding portions of the concavo-convex structure.

8. The dish washer according to claim 5, wherein the gap has a height of about 2 mm to about 20 mm.

9. The dish washer according to claim 6, wherein a total area of the at least one slit through which air passes is about 20 $cm^2$ to about 80 $cm^2$.

10. The dish washer according to claim 1, further comprising a fan provided on an air movement course to circulate the air through the tub and the drying device.

11. A dish washer comprising:

a tub; and a drying device, the drying device comprising:

an adsorbent to adsorb moisture, a heater disposed adjacent to the adsorbent to provide hot air to the adsorbent such that the adsorbent is regenerated, and a mesh unit to form a hollow space in the adsorbent to reduce flow resistance of air passing through the adsorbent, the mesh unit comprising a distribution mesh disposed to distribute air and a mesh pipe to form a hollow passage in the adsorbent.

12. The dish washer according to claim 11, wherein the adsorbent is provided in an adsorbent case comprising at least one outlet port connected to the tub and a connection port, into which air having passed through the heater is introduced, and mesh nets to fix the adsorbent are provided in the at least one outlet port and the connection port.

13. The dish washer according to claim 12, wherein the distribution mesh is provided at a middle part of the adsorbent case such that air introduced through the connection port moves in opposite directions, and the mesh pipe is connected to the distribution mesh and extends to opposite sides of the adsorbent case.

14. The dish washer according to claim 12, wherein one side of the mesh pipe is adjacent to the connection port and the other side of the mesh pipe is adjacent to the outlet port.

15. A dish washer comprising:

a tub;

a drying device;

an adsorbent case provided in the drying device, the adsorbent case comprising an inner space in which an adsorbent to adsorb moisture contained in air in the tub is provided; and at least one mesh unit located in the inner space to form a hollow flow channel to reduce flow resistance of air passing through the adsorbent.

16. The dish washer according to claim 15, wherein a mesh ratio in terms of a percentage value obtained by dividing a volume of the mesh unit by a volume of the inner space, is about 5% to about 30%.

17. The dish washer according to claim 15, wherein a total mesh area of the mesh unit, through which air passes, is about 800 $cm^2$ to about 1500 $cm^2$.

18. The dish washer according to claim 14, wherein the adsorbent comprises a plurality of grains each having a size of about 7 mm to about 20 mm.

19. The dish washer according to claim 18, wherein the grains have a density of about 200 $kg/m^3$ to about 500 $kg/m^3$.

20. A dish washer, comprising:

a tub; and a drying device to suction air from the tub via an inlet port, to remove moisture from the air using an adsorbent, and to discharge the air from which moisture has been removed into the tub via an outlet port, the drying device comprising:

an adsorbent case to store the adsorbent; and a mesh unit comprising a hollow structure disposed inside the adsorbent case which directs air suctioned from the tub toward the outlet port.

21. The dish washer according to claim 20, further comprising a heater, wherein:

the heater is disposed inside a heater case, the adsorbent case includes a connection port connected to the heater case to receive air suctioned from the tub, and the mesh unit includes a distribution mesh and a plurality of pipes extending from a first side of the distribution mesh and a second side of the distribution mesh, the distribution mesh receiving air from the heater case via the connection port and distributing the air into the plurality of pipes.

22. The dish washer according to claim 21, wherein:

the plurality of pipes include holes to discharge the air distributed from the distribution mesh, toward the outlet port.

23. The dish washer according to claim 22, wherein:

outlet ports are disposed on opposite sides of a top of the adsorbent case and air is discharged from the holes of the plurality of pipes toward the outlet ports.

24. The dish washer according to claim 20, further comprising a heater, wherein:

the heater is disposed inside a heater case, and the heater case has a length in a longitudinal direction which is shorter than a length of the adsorbent case in the longitudinal direction.

25. The dish washer according to claim 20, further comprising a heater, wherein:

the mesh unit includes a mesh pipe and a mesh net surrounding the mesh pipe, the heater is disposed inside the mesh pipe, and the adsorbent is disposed between the mesh pipe and the mesh net.

26. The dish washer according to claim 20, further comprising a heater, wherein:

the heater is disposed inside a heater case, the adsorbent case includes a plurality of connection ports connected to the heater case to receive air suctioned from the tub, and a plurality of hollow structures are disposed in the adsorbent case which correspond to the connection ports, the plurality of hollow structures receiving air from the heater case via the corresponding connection ports and directing the air toward a top of the adsorbent case.

27. The dish washer according to claim 26, wherein:

the top of the adsorbent case includes an outer top, an inner top having a plurality of slits, and a gap defined by the distance between the inner top and the outer top, and the plurality of hollow structures direct air through the plurality of slits into the gap, and the air is discharged from the gap into the tub via the outlet port.

28. The dish washer according to claim 27, wherein the outlet port is disposed at a side of the adsorbent case which is adjacent to the top of the adsorbent case.

* * * * *